US005370955A

United States Patent [19]

Toth et al.

[11] Patent Number: 5,370,955

[45] Date of Patent: Dec. 6, 1994

[54] ELECTROPHOTOGRAPHIC ELEMENTS WITH ARYLAMINE POLYCONDENSATION POLYMERS

[75] Inventors: Alan E. J. Toth, Burlington; Walter Mychajlowskij, Georgetown, both of Canada; Dale S. Renfer, Webster, N.Y.

[73] Assignee: Xerox Corporation, Stamford, Conn.

[21] Appl. No.: 126,415

[22] Filed: Sep. 27, 1993

[51] Int. Cl.[5] ..... G03G 5/047

[52] U.S. Cl. ..... 430/59

[58] Field of Search ..... 430/59

[56] References Cited

U.S. PATENT DOCUMENTS 4,265,990 5/1981 Stolka et al. ..... 430/59

4,801,517 1/1989 Frechet et al. ..... 430/59

4,806,443 2/1989 Yanus et al. ..... 430/56

4,806,444 2/1989 Yanus et al. ..... 430/56

5,028,687 7/1991 Yanus et al. ..... 528/203

*Primary Examiner*—Roland Martin

*Attorney, Agent, or Firm*—E. O. Palallo

[57] ABSTRACT

A process for the preparation of aryl amine polycondensation polymers comprising the interfacial polymerization of an aryl amine diol dissolved in an alkaline aqueous phase, to which has been added a water miscible organic solvent, with a bifunctional acid halide dissolved in a water immiscible organic solvent, and wherein said polymers possess a high molecular weight of from between about 50,000 to about 350,000, and narrow molecular weight distribution $M_w/M_n$ of from about 1 to about 4.

5 Claims, No Drawings

ELECTROPHOTOGRAPHIC ELEMENTS WITH ARYLAMINE POLYCONDENSATION POLYMERS

BACKGROUND OF THE INVENTION

The present invention is directed generally to processes for the preparation of aryl amine polycondensation polymers, and photoconductive imaging members thereof. More specifically, the present invention is directed to processes for the preparation of poly(ethercarbonates) which can be selected as a charge transport layer in a layered photoconductive imaging member with a photogenerating layer and a supporting substrate, reference for example U.S. Pat. Nos. 4,801,517; 4,806,444 and 4,806,443, the disclosures of which are totally incorporated herein by reference.

In embodiments, the present invention relates to the preparation of aryl amine poly(ethercarbonates) PEC by the utilization of interfacial polymerization, and the use of a water miscible cosolvent, like dioxolane to thereby simplify the procedure by avoiding a heating step to effect dissolution of the water soluble monomer and avoid undesirable oxidation effects, and wherein aryl amine poly(ethercarbonate) polymers with a high molecular weight can be obtained, for example 350,000. U.S. Pat. Nos. 4,806,443 and 5,028,687, the disclosures of which are totally incorporated herein by reference, disclose aryl amine poyl(ethercarbonates), a solution polymerization process for the preparation of aryl amine poly(ethercarbonates), and the use of these polycarbonates in imaging systems.

Illustrated in copending application U.S. Ser. No. 036,162 (D/91424), the disclosure of which is totally incorporated herein by reference, are methods for the preparation of poly(ethercarbonates) wherein a water miscible cosolvent is not selected, and more specifically there is illustrated in this application a process for the preparation of aryl amine polycondensation polymers useful in electrophotographic imaging members, which process comprises the interfacial polymerization of an aryl amine diol dissolved in an alkaline aqueous phase with a bifunctional acid halide dissolved in an organic solvent, resulting in polymers with high molecular weight and narrow molecular weight distribution ($M_w/M_n$) of from between about 50,000 to about 350,000, and a $M_w/M_n$ of from about 1 to about 4. By not using a water miscible cosolvent, the aqueous phase is heated to from about 75° to 95° C. to dissolve the dihydroxyaryl amine compound in an alkali media. During this heating step, oxidation of the dihydroxyaryl amine may result. In the present invention in embodiments, by using a water miscible cosolvent, the need to heat up the aqueous phase is eliminated thereby rendering the process much simpler. Also, disclosed in the aforementioned copending application is a process for the preparation of polycarbonates which comprises the interfacial polycondensation reaction of an alkali metal hydroxide, an aryl halide, and an aryl amine, followed by the addition of an alkyleneglycol bishaloformate; separating the organic phase from the alkali water phase comprised thereafter precipitating the product in an aliphatic alcohol, and isolating the polymer product therefrom.

The present invention relates to interfacial polymerization, and the use of a water miscible cosolvent for the synthesis of the aforementioned aryl amine poly(ethercarbonates). With interfacial polymerization instead of solution polymerization, there is enabled certain molecular weight polymers with narrow molecular weight distributions (MWD). Also, a significant improvement in the mechanical properties, including wear resistance, is obtained with the products obtained with the processes of the present invention. For example, the wear resistance of imaging members containing the polymers of the present invention is improved by a factor of about 2 to 3 as compared to a typical photoreceptor with a charge transport layer comprised of charge transporting small molecules, such as N,N'-diphenyl-N,N'-bis(3-methylphenyl)-[1,1'-biphenyl]-4,4'-diamine dissolved or dispersed in various polymers, such as polycarbonates like bisphenol A polycarbonate, including MAKROLON 5705 ®. One embodiment of the present invention is directed to an imaging member comprised of a supporting substrate, a photogenerating layer comprised of photogenerating pigments in contact therewith, and a charge, especially hole, transport layer comprised of the aryl amine poly(ethercarbonates) obtained with the processes as illustrated herein. The aforementioned imaging members are also useful in liquid development systems in that, for example, the members thereof can be resistant to liquid developer components containing hydrocarbon type solvents, such as ISOPAR ® and NORPAR ®, in that, for example, they retain their electrical and mechanical characteristics for extended time periods.

U.S. Pat. No. 4,806,443 describes a solution polymerization process for the preparation of aryl amine poly(ethercarbonates). Solution polycondensation involves the reaction of a dihydroxy aryl amine with a glycol bischloroformate in an appropriate solvent and in the presence of an organic base. With the solution process, there results polymers with relatively low molecular weights, such as from between about 40,000 to about 150,000. For example, when a high purity dihydroxyaryl amine monomer is used and when the dihydroxyaryl amine monomer selected contains small amounts of polyfunctional impurities, the polymer obtained can have a high molecular weight ($M_w$ over 200,000), and the molecular weight distributions, ($M_w/M_n$ or MWD) are wide, of the range 3 to 12. Materials with these molecular weights and large molecular weight distributions can suffer from poor mechanical performance criteria, such as excessive wear and cracking, in photoreceptor applications. For purposes of increasing the molecular weight from 200,000 to about 300,000, and thereby improving the mechanical characteristics of the polymers obtained, there is introduced during the polymerization reaction thereof crosslinking agents such as 1,3,5-benzenetricarbonyl trichloride, tri(4-hydroxyphenyl)ethane or 3,3',3'',3'''-tetrahydroxytetraphenylbenzidine. However, the use of crosslinking agents causes difficulties in controlling the molecular weight, can cause problems in electrical properties of the polymer, and cause difficulties in processability, due to increases in solution viscosities. In attempts to reduce the molecular weight distributions and thus improve the mechanical properties of these materials, fractionation of the materials is carried out, generally by the selective precipitation of higher molecular weight polymer. This can result in poor yields of the desired polymer. These and other disadvantages are avoided, or minimized with the polymers, such as polycarbonates obtained with the processes of the present invention.

Photoresponsive imaging members are known, such as those with a homogeneous layer of a single material such as vitreous selenium, or composite layered devices containing a dispersion of a photoconductive composition. An example of a composite xerographic photoconductive member is described in U.S. Pat. No. 3,121,006, which discloses finely divided particles of a photoconductive inorganic compound dispersed in an electrically insulating organic resin binder.

Photoreceptor materials comprising inorganic or organic materials wherein the charge generating and charge transport functions are performed by discrete contiguous layers are also known. Additionally, layered photoreceptor members are disclosed in the prior art, including photoreceptors having an overcoat layer of an electrically insulating polymeric material. Other layered photoresponsive devices have been disclosed, including those comprising separate photogenerating layers and charge transport layers as described in U.S. Pat. No. 4,265,990, the disclosure of which is totally incorporated herein by reference. Photoresponsive materials containing a hole injecting layer overcoated with a hole transport layer, followed by an overcoating of a photogenerating layer, and a top coating of an insulating organic resin, are disclosed in U.S. Pat. No. 4,251,612, the disclosure of which is totally incorporated herein by reference. Examples of photogenerating layers disclosed in these patents include trigonal selenium and phthalocyanines, while examples of transport layers include certain aryl diamines as illustrated therein.

Layered photoconductive imaging members useful with liquid development systems are illustrated in U.S. Pat. Nos. 4,801,517; 4,806,443 and 4,806,444, mentioned herein.

Documents illustrating layered organic electrophotographic photoconductor elements with azo, bisazo, and related photogenerating compounds, and charge transport layers, which may be dispersed in polycarbonates in some instances, include U.S. Pat. Nos. 4,390,611, 4,551,404, 4,596,754, Japanese Patent 60-64354, U.S. Pat. Nos. 4,400,455, 4,390,608, 4,327,168, 4,299,896, 4,314,015, 4,486,522, 4,486,519, 4,555,667, 4,440,845, 4,486,800, 4,309,611, 4,418,133, 4,293,628, 4,427,753, 4,495,264, 4,359,513, 3,898,084, 4,830,944; 4,820,602; and 3,898,084; the disclosures of each of the aforementioned patents being totally incorporated herein by reference.

SUMMARY OF THE INVENTION

It is an object of the present invention to provide polycarbonates, and imaging members thereof with many of the advantages illustrated herein.

It is another object of the present invention to provide processes for the preparation of polycarbonates, such as poly(ethercarbonates) (PEC) with improved mechanical characteristics.

Still another object of the present invention is to provide interfacial polymerization processes for the preparation of charge transport polycarbonates, such as poly(ethercarbonates) and photoconductive imaging members thereof.

It is another object of the present invention to provide interfacial polymerization processes for the preparation of charge transport poly(ethercarbonates), such as aryl amine poly(ethercarbonates) with molecular weights of, for example, from between about 100,000 to about 350,000, more preferably from about 75,000 to about 250,000, and with a molecular weight distribution $M_w/M_n$ of from about 1.5 to about 3.0. The molecular weight most preferred is determined by the solubility of the polymer in the solvents selected for photoreceptor fabrication, and the solution viscosity at a given molecular weight. In embodiments, the method of photoreceptor fabrication can determine the desired molecular weight range, for example doctor blade coating, dip coating, spray coating and gravure coating methods all have their own viscosity requirements at a specified solids content. The molecular weight most preferred is determined by the mechanical wear resistance of the polymer which enables extended photoreceptor life.

It is another object of the present invention to provide interfacial polymerization processes for the preparation of charge transport poly(ethercarbonates), such as aryl amine poly(ethercarbonates), with higher molecular weights and narrower molecular weight distributions, $M_w/M_n$, than obtained with known solution polycondensation processes and wherein oxidation is avoided or minimized by the use of a water miscible cosolvent process, and wherein PEC can be obtained by interfacial polycondensation (IFP) where the DHTBD potassium salt can be dissolved in an aqueous phase at, for example, 5° C. using a cosolvent.

It is another object of the present invention to provide interfacial polymerization processes for the preparation of charge transport polycarbonates, such as poly(ethercarbonates), with increased resistant to abrasion when, for example, exposed to blade cleaning devices than obtained with known solution polycondensation processes.

Another object of the present invention is to provide interfacial polymerization processes for the preparation of poly(ethercarbonates), such as aryl amine poly(ethercarbonates), wherein the stoichiometric control of reactant amounts for solution polymerization is avoided, and high purity starting reactants, such as N,N'-diphenyl-N,N'-bis(3-hydroxyphenyl)[1,1'-biphenyl]-4,4'-diamine, are not needed to avoid crosslinking. The interfacial polymerization processes of the present invention also enable in embodiments molecular weight control, for example the lowering or raising, of the molecular weight by, for example, simply varying the amount, or type of phase transfer catalyst selected. Moreover, the interfacial polymerization processes of the present invention can avoid the use of crosslinkers which introduce processing problems, such as low solubility and increased viscosity, to obtain high molecular weight polymers.

These and other objects of the present invention can be accomplished in embodiments by the provision of processes for the preparation of polycarbonates. More specifically, the present invention in embodiments is directed to interfacial polycondensation polymerizations for the preparation of aryl amine poly(ethercarbonates) with high molecular weights, such as for example from between about 130,000 to about 350,000 and preferably about 290,000.

In embodiments, the present invention is directed to layered imaging members and processes thereof, and wherein aryl amine components selected for the imaging members are prepared by a process which comprises the interfacial polymerization of an aryl amine diol dissolved in an alkaline aqueous phase, to which has been added a water miscible organic solvent, with a bifunctional acid halide dissolved in a water immiscible organic solvent, and wherein said polymers possess a high molecular weight and narrow molecular weight distribution ($M_w/M_n$) of from between about 50,000 to about 350,000, and a $M_w/M_n$ of from about 1 to about 4, respectively.

In one embodiment, the process of the present invention comprises the reaction of a dihydroxy aryl amine compound, dissolved in a water miscible organic solvent mixture with a coreactant glycol bischloroformate compound dissolved in a water immiscible organic solvent.

To prepare an aryl amine polymer by interfacial polycondensation, in embodiments an aqueous solution of a dihydroxyarylamine compound may be formed, preferably at a strongly basic pH. To allow for the aryl amine diol to dissolve into the aqueous solution at room temperature, a water miscible organic solvent, such as dioxolane, is added to the aqueous phase. An organic solution of a diacid halide, for example a bishaloformate, is then added and the polymerization performed at the desired temperature. The interfacial polycondensation is preferably performed with a phase transfer agent, or catalyst, which allows the aryl amine diol to be transferred from the aqueous phase into an organic phase.

More specifically, the process of the present invention comprises dissolving a dihydroxyarylamine in water with stirring in the presence of an alkali metal hydroxide, a phase transfer agent and a water miscible organic solvent. The aqueous solution preferably has a strongly basic pH, for example about 12 or higher, to allow for the diol to dissolve into the aqueous solution. The aqueous solution contains the phase transfer agent, such as an arylalkyl ammonium halide, which allows the reaction to occur at the interface of the aqueous and organic phases as the diol is transferred from the aqueous phase into an organic phase. A solution comprised of the diacid halide, such as an alkylene glycol bishaloformate, in a suitable organic solvent is then added and the polymerization effected usually at room temperature or below.

The aqueous solution has a weight percent ratio of the dihydroxyarylamine to water of from about 0.01 to about 0.50 and preferably from about 0.05 to about 0.20. The molar ratio of alkali metal hydroxide to the dihydroxyarylamine is from about 1 to 5 and preferably from about 1.0 to about 2.0, and the concentration of arylalkyl ammonium halide to dihydroxyarylamine is from about 0.1 to about 20 percent and preferably from about 1 to about 10 percent with the concentration of water miscible organic solvent to water being about 1:3 or sufficient to allow dissolution of the dihydroxyarylamine and no more. The aqueous solution has a weight percent ratio of the water miscible organic solvent to water of about 1:3, and the like, that is an amount sufficient to cause dissolution of the dihydroxyarylamine. Suitable specific water miscible organic solvents include dioxolane, tetrahydrofuran, dimethyl sulfoxide, dimethylformamide, 1,4-dioxane and acetone. The solution is then cooled to, for example, a temperature of from about 0° to about 25° C. and preferably from about 0° to about 10° C. Thereafter, there is added, with vigorous stirring, to the cooled solution over a period of time, for example from between about 0.1 and about 2 and preferably from about 0.5 to about 1 hour, a solution comprised of the diacid halide, such as an alkylene glycol bischloroformate, in a suitable organic solvent. Suitable organic solvents include alkylene halides like methylene chloride, carbon tetrachloride, dichloroethane, tetrachloroethane, and halo aromatics like chlorobenzenes, toluene, xylene and the like. Methylene chloride is the preferred organic solvent. The weight percent ratio of the alkylene glycol bischloroformate to organic solvent can range from about 0.01 to about 0.50 and preferably from about 0.05 to about 0.20. After addition, the reaction mixture is allowed to warm up to room temperature and further stirred for a period of time of from about 1 to about 16 hours and preferably from about 1 to about 5 hours. The resulting mixture is allowed to remain undisturbed for phase separation, and the organic phase comprised of the organic solvent and the polymer is separated from the alkaline water phase. Subsequent to washing with, for example, water, the organic phase is then precipitated into an aliphatic alcohol, such as methanol, ethanol, propanol, butanol, and the like. The polymer resulting is isolated by, for example, filtration, and thereafter the polymer is dried in an oven at, for example, a temperature of about 40° C. The product was then identified as aryl amine poly(ethercarbonate) by NMR and IR. The polymer in embodiments had a weight average molecular weight as determined by gel permeation chromatography of from between about 50,000 to about 350,000 and preferably from about 225,000 to about 320,000 in embodiments, and an $M_w/M_n$ distribution of from about 1 to about 4, and preferably 1.5 to 3.0. When a similar process was accomplished with a solution polycondensation the molecular weight ($M_w$) of the poly(ethercarbonate) was about 200,000 to about 300,000 and the molecular weight distribution of 3.5 to 12.0. When the polymerization was accomplished with a solution polycondensation using a very high purity monomer, the molecular weight ($M_w$) of the poly(ethercarbonate) was about 50,000 to about 150,000. The corresponding solution polycondensation processes are illustrated in U.S. Pat. No. 4,806,443, the entire disclosure of this patent being incorporated herein by reference.

Typical dihydoxy aryl amine compounds are disclosed in U.S Pat. Nos. 4,588,666, 4,801,517, 4,806,443 and 4,806,444, the disclosures of these patents being incorporated herein by reference.

The diacid halide selected in effective amounts may be any suitable diacid halide, such as a bishaloformate, preferably a bischloroformate. Typical glycol chloroformate compounds which can be employed are ethylene glycol bischloroformate, diethylene glycol bischloroformate, triethylene glycol bischloroformate and propytene glycol bischloroformate.

The phase transfer agent selected in effective amounts as indicated herein may be any suitable transfer agent including an arylalkyl ammonium halide, such as benzyltriethyl ammonium chloride, benzyltrimethyl ammonium chloride, benzyldimethyldodecyl ammonium bromide, benzyldimethylstearyl ammonium chloride, benzyldimethyltetradecyl ammonium chloride, benzyltributyl ammonium chloride, bromide or iodide, butyltripropyl ammonium bromide, cetyldimethylethyl ammonium bromide, cetyltrimethyl ammonium bromide or chloride, tetrabutyl ammonium bromide, chloride, fluoride or iodide, tetraethyl ammonium bromide, chloride, fluoride or iodide, tetramethyl ammonium bromide, chloride, fluoride or iodide, tetrapropyl ammonium bromide, chloride, fluoride or iodide, benzyltriphenylphosphonium chloride or bromide, methyltriphenylphosphonium bromide, methyltriphenylarsonium iodide, cetylpyridinium chloride, hexadecyltributylphosphonium bromide, and the like.

One layered photoconductive imaging member can be comprised of a conductive aluminum supporting substrate, a photogenerating layer comprising an inorganic, or an organic photogenerating pigment, such as trigonal selenium, titanyl phthalocyanine, vanadyl phthalocyanine, metal free phthalocyanines, metal phthalocyanines, perylenes, and the like optionally dispersed in a resinous binder composition and a charge transport layer which comprises an aryl amine polycondensation polymer obtained with the process of the present invention as charge transporting moiety dispersed in an inactive resinous binder.

A photoconductive imaging member of the present invention also can be comprised of a conductive substrate, a hole blocking metal oxide layer thereover, an optional adhesive layer thereover, a photogenerating layer comprised of trigonal selenium dispersed in a resinous binder composition, and an aryl amine poly(ethercarbonate) obtained with the processes illustrated herein, reference Example III, with an $M_w$ of 236,000 and an $M_n$ of 110,000 transport layer as the top layer, optionally dispersed in a resinous binder.

Examples of photogenerating pigments, substrates, adhesive layers, and the like are known, reference for example U.S. Pat. No. 4,801,517, the disclosure of which is totally incorporated herein by reference.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include nickel, stainless steel, conductive plastics, aluminum, semitransparent aluminum, titanium, and the like. The substrate can be of any other conventional material, including organic and copied inorganic materials. Typical substrate materials include insulating nonconducting materials such as various resins known for this purpose including polycarbonates, polyamides, polyurethanes, paper, glass, plastic, polyesters, such as MYLAR ® (available from DuPont) or MELINEX 447 ® (available from ICI Americas, Inc.), and the like. If desired, a conductive substrate can be coated onto an insulating material. In addition, the substrate can comprise a metallized plastic, such as titanized or aluminized MYLAR ®, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate preferably comprises a metal oxide such as aluminum oxide, nickel oxide, titanium oxide, and the like.

The photoconductive imaging member may optionally contain a charge blocking layer situated between the conductive substrate and the photogenerating layer. This layer may comprise metal oxides, such as aluminum oxide and the like, or materials such as silanes and nylons. Additional examples of suitable materials include polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures thereof, copolymers thereof, and the like. The primary purpose of this layer is to prevent charge injection from the substrate during and after charging.

In embodiments, intermediate adhesive layers situated between the substrate and subsequently applied layers may be desirable to improve adhesion. Typical adhesive layers include film-forming polymers such as polyester, polyvinylbutyral, polyvinylpyrrolidone, polycarbonate, polyurethane, polymethyl methacrylate, and the like as well as mixtures thereof. Since the surface of the substrate can be a metal oxide layer or an adhesive layer, the expression "substrate" as employed herein is intended to include in embodiments a metal oxide layer with or without an adhesive layer on a metal oxide layer.

In addition, the photoconductive imaging member may also optionally contain an adhesive interface layer situated between the hole blocking layer and the photogenerating layer. This layer may comprise a polymeric material such as polyester, polyvinyl butyral, polyvinyl pyrrolidone and the like.

The photogenerating layer comprises, for example, metal phthalocyanines, metal free phthalocyanines, vanadyl phthalocyanine, titanyl phthalocyanines, squaraines, perylenes, selenium, selenium alloys, such as selenium tellurium, trigonal selenium, and the like. Generally, this layer has a thickness of from between about 0.05 micron to about 10 microns or more, and in embodiments has a thickness of from about 0.1 micron to about 3 microns. The thickness of this layer is dependent primarily upon the concentration of photogenerating material in the layer, which may generally vary from about 5 to 100 percent. When the photogenerating material is present in a binder material, the binder preferably contains from about 30 to about 95 percent by weight of the photogenerating material, and preferably contains about 80 percent by weight of the photogenerating material.

Active carrier transport resins may be employed as the binder in the photogenerating layer. These resins are particularly useful where the concentration of carrier generating pigment particles is low and the thickness of the carrier generating layer is substantially thicker than about 0.7 micrometer. The active resin commonly used as the binder is polyvinylcarbazole whose function is to transport carriers which would otherwise be trapped in the layer.

The electrically active aryl amine polycondensation polymers of this invention can be employed in the generator layer replacing the polyvinylcarbazole binder or other active or inactive binder. Part or all of the active resin materials to be employed in the generator layer may be replaced by the electrically active aryl amine polycondensation polymers of this invention.

The active charge transport layer comprises an aryl amine polycondensation polymer obtained by the processes of the present invention and capable of supporting the injection of photogenerated holes from the charge generation layer and allowing the transport of these holes through the transport layer to selectively discharge the surface charge. When the photogenerating layer is sandwiched between the conductive layer and the active charge transport layer, the transport layer not only serves to transport holes, but also protects the photoconductive layer from abrasion or chemical attack and therefore extends the operating life of the electrophotographic imaging member. The charge transport layer should exhibit negligible, if any, discharge when exposed to a wavelength of light useful in xerography, for example 4,000 Angstroms to 9,000 Angstroms. Therefore, the charge transport layer is substantially transparent to radiation in a region in which the photoconductor is to be used. Thus, the active charge transport layer is a substantially nonphotoconductive material which supports the injection of photogenerated holes from the generator layer. The active transport layer is normally transparent when exposure is affected through the active transport layer to ensure that most of the incident radiation is utilized by the underlying charge carrier generator layer for efficient photogeneration. When used with a transparent substrate, imagewise exposure may be accomplished through the substrate with all the light passing through the substrate, and the active transport material need not be transmitting in the wavelength region used. The charge transport layer in conjunction with the generation layer is a material which can be an insulator to the extent that an electrostatic charge placed on the transport layer is not conducted in the absence of illumination.

Part or all of the transport material comprising a hole transporting small molecule in an inactive binder to be employed in the transport layer may be replaced by the active materials described above comprising an aryl amine polycondensation polymer film forming material. The hole transporting small molecule inactive resin binder composition may be entirely replaced with 100 percent of an aryl amine polycondensation polymer of the present invention.

An especially preferred transport layer employed in one of the two electrically operative layers in the multilayer photoconductor of this invention comprises from about 50 percent to about 100 percent by weight of poly[N,N'-diphenyl-N,N'-bis{3-hydroxyphenyl-}—{1,1'-biphenyl}-4,4'-diamine] diethylene glycol biscarbonate and from about 0 percent to about 50, and preferably 10 to about 50 percent by weight of bisphenol A polycarbonate.

The electrophotographic member of the present invention exhibits greater resistance to cracking, crazing, crystallization, and phase separation as compared to similar imaging members using nonpolymeric aryl amine compounds. These members also exhibit significantly improved resistance to abrasion when exposed to blade cleaning devices compared to similar imaging members using nonpolymeric aryl amine compounds or aryl amine polycondensation polymers obtained by solution polycondensation.

Specific embodiments of the invention will now be described in detail. These Examples are intended to be illustrative, and the invention is not limited to the materials, conditions, or process parameters set forth in these embodiments. All parts and percentages are by weight unless otherwise indicated. Comparative Examples are also presented.

COMPARATIVE EXAMPLE I

Following the solution polymerization procedure of U.S. Pat. No. 4,806,443, the disclosure of which is totally incorporated herein by reference, poly[N,N'-diphenyl-N,N'-bis{3-hydroxyphenyl}-1,1'-biphenyl}-4,4'-diamine] diethylene glycol biscarbonate was prepared. The molecular weight, as determined by gel permeation chromatography, against a polystyrene standard was $M_w$ 200,000 and $M_n$ 53,000 (MWD 3.79). In another process, by the solution polymerization of U.S. Pat. No. 4,806,443, poly[N,N'-diphenyl-N,N'-bis,{3-hydroxyphenyl}-{1,1'-biphenyl}-4,4'-diamine] diethylene glycol biscarbonate was prepared, and had an $M_w$ of 311,000, and an $M_n$ of 28,800 (MWD 10.8). The high molecular weight and the wide molecular weight distribution (MWD over 3.0) of the polymers obtained is an indication that the monomer, N,N'-di(3-hydroxyphenyl)-N,N'-diphenyl-{1,1'-biphenyl}-4,4'-diamine, contains small amounts of polyhydroxy derivatives.

COMPARATIVE EXAMPLE II

In a 500 milliliter reaction flask equipped with mechanical stirring (glass rod and TEFLON® paddle), nitrogen inlet, temperature probe, and addition port fitted with a septum, the following reagents are charged, potassium hydroxide (5.6 grams), benzyltriethyl ammonium chloride (0.9 gram), deionized water (120 grams), and N,N'-di(3-hydroxyphenyl)-N,N'-diphenyl-{1,1'-biphenyl}-4,4'-diamine(DHTBD)(10.4 grams). The solution is heated to 85° C. under a nitrogen blanket in a constant temperature bath and appears as a clear yellow solution. The solution is then cooled to 5° C. while a solution of diethylene glycol bischloroformate/methylene chloride is prepared comprised of diethylene glycol bischloroformate (5.0 grams), and methylene chloride (160 grams). This solution is charged to a glass syringe and placed in a syringe pump with the pump rate at 2.0 milliliters/minute while stirring at 450 rpm at a reaction temperature of 5° C. which is maintained by the constant temperature bath. After the diethylene glycol bischloroformate addition, the reaction mixture is stirred for an additional 60 minutes at 20° C., while an increase in viscosity occurs. An additional 132 grams of methylene chloride is added after the 1 hour mix and the mixture is transferred to a separatory funnel for phase separation of organic (bottom) and alkali aqueous phase (top). The organic layer is discharged into a second separatory funnel and washed with 150 milliliters of deionized water. The procedure is repeated twice more ceasing when the pH of the aqueous phase is less than 7 and the conductivity is less than 10 μS. The aqueous layer is discarded. The washed polymer solution is then dried with magnesium sulfate, filtered, and precipitated into 2.5 liter of methanol with vigorous stirring. The precipitated polymer product similar to the product of Comparative Example I is filtered and dried in a 60° C. in a vacuum oven overnight with a yield of 11.4 grams.

EXAMPLE III

In a 500 milliliter reaction flask equipped with mechanical stirring (glass rod and TEFLON® paddle), nitrogen inlet, temperature probe. and addition port fitted with a septum, the following reagents are charged: potassium hydroxide (5.6 grams), benzyltriethylammonium chloride (0.9 gram), deionized water ( 120 grams), dioxolane (30 grams) and N,N'-di(3-hydroxyphenyl)-N,N'-diphenyl-{1,1'-biphenyl}-4,4'-diamine, (DHTBD) (10.4 grams). The solution is chilled to 5° C. under a nitrogen blanket in a constant temperature bath (Lauda) and appears as a clear yellow solution. Stirring under nitrogen for 15 minutes prior to diethylene glycol bischloroformate addition is accomplished while a solution of diethylene glycol bischloroformate/methylene chloride is prepared comprised of diethylene glycol bischloroformate (5.0 grams), and methylene chloride (160 grams). This solution is charged to a glass syringe and placed in a syringe pump with the pump rate at 2.0 milliliters/minute while stirring at 450 rpm at a reaction temperature of 5° C. which is maintained by the constant temperature bath. After the diethylene glycol bischloroformate addition, the reaction mixture is stirred for an additional 60 minutes at 20° C., while an increase in viscosity occurs. An additional 132 grams of methylene chloride is added after the 1 hour mix and the mixture is transferred to a separatory funnel for phase separation of organic (bottom) and alkali aqueous phase (top). The organic layer is discharged into a second separatory funnel and washed with 150 milliliters of deionized water. The procedure is repeated twice more stopping when the pH of the aqueous phase is less than 7 and the conductivity is less than 10 μS. The aqueous layer is discarded. The washed polymer solution is then dried with magnesium sulfate, filtered, and precipitated into 2.5 liters of methanol. The precipitated polymer PEC is filtered and dried in a 60° C. vacuum oven overnight with a yield of 11.8 grams. From the comparison as shown in Table 1, Example II of copending patent application U.S. Ser. No. 036,162 (D/91424) interfacial procedure, and Example III by the cosolvent interfacial procedure of the present invention it is establishes that the cosolvent procedure reduces process time by the pre-reaction shorter dissolution time.

TABLE 1

| EXAMPLE | Dissolution Time (DHTBD Salt) | $M_w$ (K) | MWD | Pmax (K) |
|---|---|---|---|---|
| II | 70 min.* | 240.8 | 2.54 | 131 |
| III | 1 min. | 298.3 | 2.10 | 169.6 |

*(using preheated and prechilled baths - time with normal heating/cooling of 2 to 3 hours)

EXAMPLE IV

In a 2,000 milliliter jacketed reaction flask equipped with mechanical stirring, nitrogen inlet, temperature probe, and addition port fitted with a septum, the following reagents are charged: potassium hydroxide (33.6 grams), benzyltriethylammonium chloride (5.4 grams), deionized water (720.0 grams), dioxolane (180.0 grams) and N,N'-di(3-hydroxyphenyl)-N,N'-diphenyl-{1,1'-biphenyl}-4,4'-diamine (DHTBD) (63.0 grams). The solution is chilled to 5° C. in a constant temperature bath (Lauda) and appears as a clear yellow solution. Stirring under nitrogen for 15 minutes is accomplished prior to diethylene glycol bischloroformate addition while a solution of diethylene glycol bischloroformate/methylene chloride is prepared comprised of diethylene glycol bischloroformate (5.0 grams) and methylene chloride (160 grams). This solution is charged to a glass syringe 90 milliliters at a time and placed in a syringe pump with the pump rate at 12.0 milliliters/minute while stirring at 1,000 rpm at a reaction temperature of 5° C. which is maintained by constant temperature glycol through the jacket. After the diethylene glycol bischloroformate addition, the reaction mixture is stirred for an additional 90 minutes at 20° C., while an increase in viscosity occurs. An additional 960 grams of methylene chloride is added after the 1 hour mix and the mixture is transferred to a 4 liter separatory funnel for phase separation of organic (bottom) and alkali aqueous phase (top). The organic layer is discharged into a second separatory funnel and washed with 1,000 milliliters of deionized water. The procedure is repeated twice more ceasing when the pH of the aqueous phase is less than 7 and the conductivity is less than 10 μS. The aqueous layer is discarded. The washed polymer solution is then dried with magnesium sulfate, filtered, and precipitated into 8 liters of methanol. The precipitated polymer PEC is filtered and dried in a 60° C. vacuum oven overnight with a yield of about 75 grams. This scale-up procedure was repeated 3 times, IVb, VIc, and IVd. Table 2 summarizes processes at the 2 liter scale in the glass reaction flask and demonstrates scaleability and reproducibility of $M_w$ and MWD when the cosolvent process of the present invention is used.

TABLE 2

| EXAMPLE | $M_w$ (K) | MWD | Pmax. (K) |
|---|---|---|---|
| IVa | 273.1 | 2.66 | 136.8 |
| IVb | 268.7 | 2.26 | 138.4 |
| IVc | 264.8 | 2.11 | 137.5 |
| IVd | 271.8 | 2.28 | 149.7 |

EXAMPLE V

A layered photoresponsive imaging member comprised of poly[N,N'-diphenyl-N,N'-bis(3-hydroxyphenyl)-{1,1'-biphenyl}-4,4'-diamine] diethylene glycol hiscarbonate as the charge transport layer, and a vanadyl phthalocyanine generator layer was fabricated as follows.

A titanized MYLAR® substrate, thickness of 75 microns, was coated using a Bird film applicator with a solution of 1 milliliter of 3-aminopropyltrimethoxysilane in 100 milliliters of ethanol. The coating was heated at 110° C. for 10 minutes, resulting in the formation of a 0.1 micron thick polysiloxane layer. A dispersion of a photogenerator prepared by ball milling a mixture of 0.3 gram of vanadyl phthalocyanine and 0.7 gram of VITEL PE-200™ polyester (Goodyear) in 70 grams of methylene chloride for 24 hours was then coated with a Bird film applicator on top of the polysiloxane layer. After drying the coating in a forced air oven at 135° C. for 10 minutes, a 0.8 micron thick vanadyl phthalocyanine photogenerating layer was obtained. A charge transport layer is prepared by dissolving 1.5 grams of poly[N,N'-diphenyl-N,N'-bis(3-hydroxyphenyl)-{1,1'-biphenyl}-4,4'-diamine] diethylene glycol biscarbonate obtained by the process of the present invention, Example IV, in 10 milliliters of methylene chloride. A layer of this mixture is formed on top of the photogenerating vanadyl phthalocyanine layer using a Bird film applicator. The coating is then vacuum dried at 110° C. for 20 minutes to form a 22 micron thick dry layer of the charge transport material. The layered photoresponsive imaging member was tested electrically as follows.

The xerographic electrical properties of the imaging member was determined by electrostatically charging the surfaces thereof with a corona discharge source until the surface potentials, as measured by a capacitively coupled probe attached to an electrometer, attained an initial value $V_o$ of about −800 volts. After resting for 0.5 second in the dark, the charged members reached a surface potential of $V_{ddp}$, dark development potential, and each member was then exposed to light from a filtered Xenon lamp with a XBO 150 watt bulb. A reduction in surface potential to a $V_{bg}$ value, background potential, due to photodischarge effect was observed. The background potential was reduced by exposing with a light intensity about 10 times greater than the expose energy. The resulting potential on the imaging member was designated as the residual potential, $V_r$. The dark decay in volt/second was calculated as $(V_o—V_{ddp})/0.5$. The percent of photodischarge was calculated as 100 percent $(V_{ddp}—V_{bg})/V_{ddp}$. The desired wavelength and energy of the expose light was determined by the type of filters placed in front of the lamp. The broad band white light (400 to 700 nanometers) photosensitivity of this imaging member was measured by using an infrared cut-off filter whereas the monochromatic light photosensitivity was determined using narrow band-pass filter. The photosensitivity of the imaging members is usually provided in terms of the amount of expose energy in erg/cm$^2$, designated as $E_{\frac{1}{2}}$, required to achieve 50 percent of photodischarge from the dark development potential. The higher the photosensitivity, the smaller is the $E_{\frac{1}{2}}$ value. The devices were subjected to 1,000 cycles of repeated charging, discharging and erase to determine the cycling stability.

The device as tested according to the procedures described above indicated excellent photosensitivity with $E_{\frac{1}{2}}$ of 4.8 ergs/cm$^2$ for broad band white light and $E_{1/2}$ of 3.3 ergs/cm$^2$ for exposure with 800 nanometers of light and a residual potential of 20 volts. Upon repeated cycling for 1,000 cycles, the device was stable as evidenced by no change in $V_{ddp}$ or $V_r$.

EXAMPLE VI

A layered imaging member was fabricated as described in Example V. More specifically, a solution was prepared by dissolving 1.5 grams of poly[N,N'-diphenyl-N,N'-bis(3-hydroxyphenyl)-{1,1'-biphenyl}-4,4'-diamine] diethylene glycol biscarbonate in 10 milliliters of methylene chloride. A layer of this mixture is formed on top of a 200 milliliters×200 milliliters highly reflective aluminum platen. The coating is then vacuum dried at 110° C. for 20 minutes to form a 22 micron thick dry layer of the charge transport material. A wear test fixture was set up to measure the relative wear and wear rates of charge transport layers subjected to toner interactions and blade cleaning.

The wear test fixture was comprised of a 200 milliliters×200 milliliters platen to which is affixed the test specimen or sample imaging member. The platen rotates at 50 rpm. An abrading agent, a toner of styrene n-butyl methacrylate, 90 weight percent, carbon black REGAL 330®, 8 weight percent, and distearyl dimethyl ammonium methyl sulfate, 2 weight percent, contained in a cassette was caused to contact the prepared sample from a supply sump, which is located above the platen and supplies the abrading agent in 0.12 to 0.13 gram amounts every 100 seconds. The abrading agent was distributed on the test sample by a 9 centimeters long, 2 milliliters thick polyurethane blade used in the Xerox Corporation 5012 machine. The blade was held in the "doctor" configuration at a 21 degree angle to the test sample surface with a normal force of 29 grams/centimeter of blade length. Thickness measurements were obtained by a Photal MCPD-110A Spectro Multichannel Photodetector, a product of Otsuka Electronics. The sample thickness was achieved by averaging from 64 sample sites on the platen and was reproducible to + or −1 nanometer using appropriate calibration standards.

The wear was determined as the loss in thickness of the charge transport layer and is the difference in thickness of the charge transport layer before and after the wear test. The wear is expressed in nanometers. The wear rate is obtained by dividing the wear by the number of cycles and is expressed as nanometers/k cycles. The wear rate is normalized and is independent of any variations in the total number of cycles of the wear tests.

The data obtained is shown in Table 3. Also shown for comparison are results of image member wear testing with a polycarbonate (MAKROLON 5705®) layer and a charge transport layer comprised of 40 weight percent of N,N'-diphenyl-N,N'-bis(3-methylphenyl)-[1,1'-biphenyl]4,4'-diamine molecularly dispersed in 60 weight percent polycarbonate (MAKROLON 5705®).

TABLE 3

EFFECT OF POLYMER ON THE WEAR RATE (TEST FIXTURE #1)

| POLYMER BINDER SAMPLE | MOLECULAR WEIGHT $M_w$ | $M_n$ | MWD | Wear Rate nm/K Cycle |
|---|---|---|---|---|
| 40% Aryl Amine 60% Polycarbonate | | | | 20 |
| Example I Polymer (High $M_w$ by Solution Polymerization) | 200K | 53K | 3.79 | 22 |
| Example II Polymer (High $M_w$ by Interfacial Polymerization) | 241K | 109K | 2.20 | 11 |
| Example III Polymer (High $M_w$ by Cosolvent Interfacial Polymerization) | 293K | 123K | 2.38 | 10 |

The results on this wear fixture evidence that the wear rate of the high molecular weight, narrow polydispersity (MWD) poly[N,N'-diphenyl-N,N'-bis(3-hydroxyphenyl)-{1,1'-biphenyl}-4,4'-diamine] diethylene glycol biscarbonate obtained by interfacial polymerization was significantly less by a factor of about 2 compared to a high molecular weight, wide polydispersity (MWD) poly[N,N'-diphenyl-N,N'-bis(3-hydroxyphenyl)-{1,1'-biphenyl}-4,4'-diamine] diethylene glycol biscarbonate obtained by solution polymerization as described in U.S. Pat. No. 4,806,443. Furthermore, the wear rate of the high molecular weight, narrow polydispersity (MWD) poly[N,N'-diphenyl-N,N'-bis(3-hydroxyphenyl)-{1,1'-biphenyl}-4,4'-diamine] diethylene glycol biscarbonate obtained by interfacial polymerization of the present invention was significantly less by a factor of about 2 as compared to the wear rate of a charge transport layer of N,N'-diphenyl-N,N'-bis(3-methylphenyl)-[1,1'-biphenyl]-4,4'-diamine molecularly dispersed in polycarbonate (MAKROLON 5705®).

Other embodiments and modifications of the present invention may occur to those skilled in the art subsequent to a review of the information presented herein; these embodiments and modifications, as well as equivalents thereof, are also included within the scope of this invention.

What is claimed is:

1. A photoconductive imaging member comprised of a supporting substrate, a photogenerating layer, and a charge transport layer thereover comprised of aryl amine polycondensation polymers with a high molecular weight of about 298,300, 273,100, 268,700, 264,800 or 271,800, and with a narrow molecular weight distribution ($M_w/M_n$) of from about 1.5 to about 3.0, respectively, and which member possesses abrasion resistance; and wherein said polycondensation polymers are obtained by a process comprising interfacial polymerization of an aryl amine diol dissolved in an alkaline aqueous phase, to which has been added a water miscible organic solvent, with a bifunctional acid halide dissolved in a water immiscible organic solvent.

2. A photoconductive imaging member in accordance with claim 1 wherein the charge transport layer is comprised of from about 50 percent to about 100 percent by weight of poly[N,N'-diphenyl-N,N'-bis{3-hydroxyphenyl}-{1,1'-biphenyl}-4,4'-diamine] diethylene glycol biscarbonate and from 0 percent to about 50 percent by weight of bisphenol A polycarbonate.

3. A photoconductive imaging member in accordance with claim 1 wherein the substrate is a metal.

4. A photoconductive imaging member in accordance with claim 1 wherein the photogenerating layer contains photogenerating inorganic or organic pigments.

5. A photoconductive imaging member in accordance with claim 4 wherein said pigments are selected from the group consisting of metal phthalocyanines, metal free phthalocyanines, vanadyl phthalocyanines, titanyl phthalocyanines, gallium phthalocyanines, selenium, selenium alloys, and trigonal selenium.

* * * * *